US010710768B2

(12) United States Patent
Tsukada et al.

(10) Patent No.: US 10,710,768 B2
(45) Date of Patent: Jul. 14, 2020

(54) PALLET

(71) Applicant: FUJI XEROX Co., Ltd., Tokyo (JP)

(72) Inventors: Shigeru Tsukada, Kanagawa (JP); Toshihiro Osawa, Kanagawa (JP); Kyoichi Imon, Kanagawa (JP); Taisuke Endo, Kanagawa (JP); Yusuke Kabe, Kanagawa (JP); Satoko Imai, Kanagawa (JP); Hideki Yamamoto, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 7 days.

(21) Appl. No.: 15/916,786

(22) Filed: Mar. 9, 2018

(65) Prior Publication Data

US 2019/0055054 A1 Feb. 21, 2019

(30) Foreign Application Priority Data

Aug. 21, 2017 (JP) ..... 2017-158706

(51) Int. Cl.

*B65D 19/00* (2006.01)
*B65D 19/38* (2006.01)
*B65D 81/02* (2006.01)

(52) U.S. Cl.

CPC ..... *B65D 19/0012* (2013.01); *B65D 19/0026* (2013.01); *B65D 19/0095* (2013.01); *B65D 19/38* (2013.01); *B65D 81/02* (2013.01); *B65D 2519/00029* (2013.01); *B65D 2519/00064* (2013.01); *B65D 2519/00099* (2013.01); *B65D 2519/00273* (2013.01); *B65D 2519/00288* (2013.01); *B65D 2519/00293* (2013.01); *B65D 2519/00323* (2013.01); *B65D 2519/00333* (2013.01); *B65D 2519/00572* (2013.01)

(58) Field of Classification Search

CPC ..... B65D 19/0012; B65D 19/0026; B65D 19/22; B65D 19/0004; B65D 19/06; B65D 19/20; B65D 19/38; B65D 2519/0029; B65D 2519/00273; B65D 2519/00288; B65D 2519/00333; B65D 21/0201; B65D 2519/00293; B65D 2519/00323; B65D 2519/00557

USPC ..... 108/51.3, 51.11, 57.17, 57.19, 57.33, 108/55.1; 206/386, 595–600

See application file for complete search history.

(56) References Cited

U.S. PATENT DOCUMENTS 1,976,474 A * 10/1934 Arata ..... B65D 81/00 217/57
2,471,693 A * 5/1949 Lilienfeld ..... B65D 19/16 108/55.1
2,614,689 A * 10/1952 Miller ..... B65D 71/0096 108/55.5

(Continued)

FOREIGN PATENT DOCUMENTS

FR 2293370 * 7/1976
GB 904198 * 8/1962

(Continued)

*Primary Examiner* — Janet M Wilkens
(74) *Attorney, Agent, or Firm* — Sughrue Mion, PLLC

(57) ABSTRACT

A pallet includes at least one top board on which a load is to be placed and at least one substantially plate-shaped stringer board that is provided independently of the top board and that has at least one non-contact portion, which is not in contact with the top board in a region between the stringer board and the top board, the stringer board being in contact with the top board in a vertical direction.

18 Claims, 12 Drawing Sheets

(56) References Cited

U.S. PATENT DOCUMENTS 3,131,655 A * 5/1964 Sellers ..... B65D 19/0073 108/55.1
3,301,200 A * 1/1967 Landsiedel ..... B65D 19/0028 108/56.1
3,682,110 A * 8/1972 Harrison ..... B65D 19/0012 108/57.33
4,060,037 A * 11/1977 Gustafsson ..... B65D 19/0024 108/55.1
4,220,099 A * 9/1980 Marchesano ..... B65D 19/0069 108/57.1
5,042,396 A * 8/1991 Shuert ..... B65D 19/0012 108/57.25
5,067,418 A * 11/1991 Carter ..... B65D 19/0073 108/56.1
5,636,577 A * 6/1997 Gow ..... B65D 19/0095 108/51.3
5,687,653 A * 11/1997 Bumgarner ..... B65D 19/0091 108/56.3
5,794,544 A * 8/1998 Shuert ..... B65D 19/0012 108/57.25
5,816,172 A * 10/1998 Carter ..... B65D 19/0095 108/51.3
5,911,179 A * 6/1999 Spiczka ..... B65D 19/0095 108/51.11
6,612,247 B1 * 9/2003 Pistner ..... B65D 19/0012 108/51.3
2004/0040477 A1 * 3/2004 Neumann ..... B65D 88/129 108/55.1
2008/0035033 A1 * 2/2008 Liebel ..... B65D 19/0026 108/56.1
2008/0257230 A1 * 10/2008 Cassina ..... B65D 19/10 108/55.1
2013/0180437 A1 * 7/2013 Wilcox ..... B65D 7/24 108/56.3
2015/0122160 A1 * 5/2015 Frautschi ..... B65D 19/0012 108/51.3
2017/0210506 A1 * 7/2017 Saliaris ..... B65D 19/0095

FOREIGN PATENT DOCUMENTS

JP 2006-347564 A 12/2006
JP 2007-069925 A 3/2007

* cited by examiner

PALLET

CROSS-REFERENCE TO RELATED APPLICATIONS

This application is based on and claims priority under 35 USC 119 from Japanese Patent Application No. 2017-158706 filed Aug. 21, 2017.

BACKGROUND

Technical Field

The present invention relates to a pallet.

SUMMARY

According to an aspect of the invention, there is provided a pallet including at least one top board on which a load is to be placed and at least one substantially plate-shaped stringer board that is provided independently of the top board and that has at least one non-contact portion, which is not in contact with the top board in a region between the stringer board and the top board, the stringer board being in contact with the top board in a vertical direction.

BRIEF DESCRIPTION OF THE DRAWINGS

Exemplary embodiments of the present invention will be described in detail based on the following figures, wherein.

DETAILED DESCRIPTION

Figure 1:
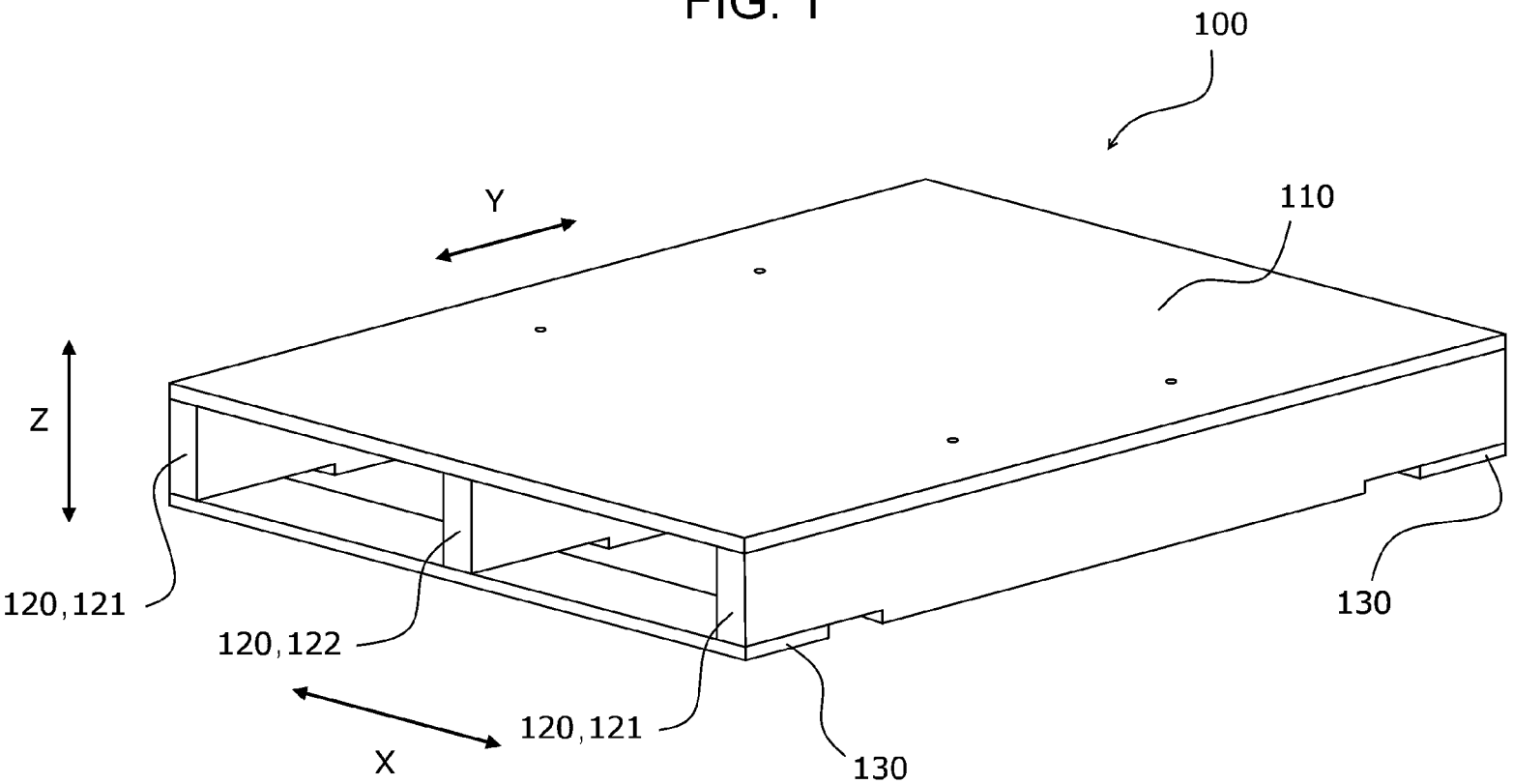
FIG. 1 is a perspective view illustrating the appearance of a pallet according to a first exemplary embodiment.

Although the present invention will now be described in detail below using exemplary embodiments and specific examples and with reference to the drawings, the present invention is not limited to the following exemplary embodiments and specific examples.

In the drawings that will be referred to in the following description, objects are schematically illustrated, and it should be noted that dimensional ratios and so forth of the objects that are illustrated in the drawings are different from those of actual objects. In addition, in the drawings, illustration of components that are not necessary for the following description is suitably omitted for ease of understanding.

Note that, for ease of understanding of the following description, the transverse direction, the depth direction, and the vertical direction (direction of gravity) in the drawings are respectively defined as the X-axis direction, the Y-axis direction, and the Z-axis direction.

First Exemplary Embodiment (1) Configuration of Pallet

Figure 2:
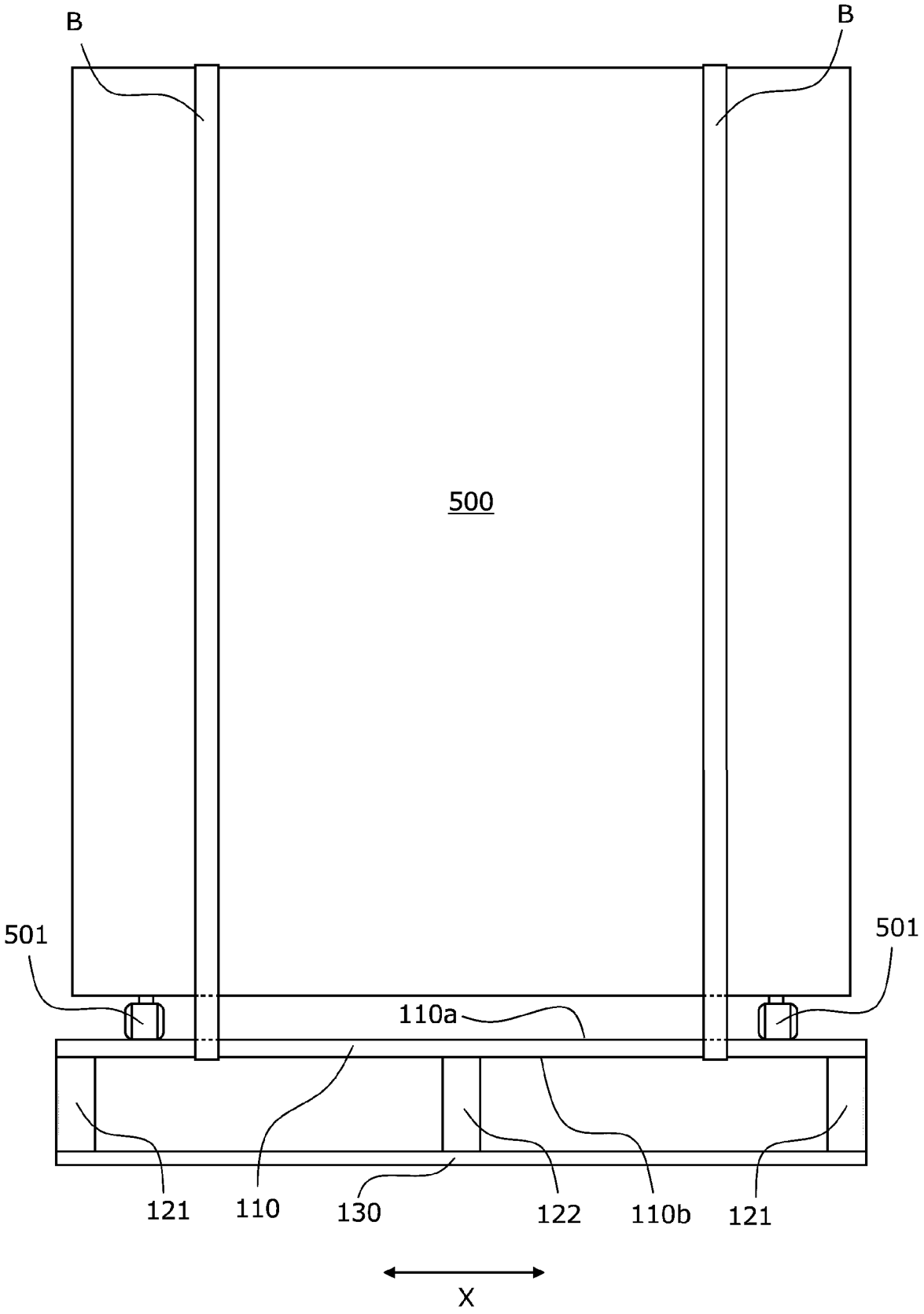
FIG. 2 is a diagram illustrating the pallet on which a load has been placed.

FIG. 1 is a perspective view illustrating the appearance of a pallet 100, and FIG. 2 is a diagram illustrating the pallet 100 on which a load 500 has been placed.

A configuration of the pallet 100 will be described below with reference to the drawings.

As illustrated in FIG. 1, the pallet 100 includes a top board 110, plural stringer boards 120, and plural bottom boards 130. The top board 110 is a board member having a rectangular shape when viewed in plan view and has a top surface 110*a* on which the load 500 is to be placed. The plural (three in the first exemplary embodiment) stringer boards 120 are support members that support the top board 110 from below and are arranged in such a manner as to extend in the depth direction (Y-axis direction) of the top board 110. The stringer boards 120 are coupled to one another by the bottom boards 130 that are arranged in a direction crossing the direction in which the stringer boards 120 extend. In the first exemplary embodiment, a configuration is employed in which the stringer boards 120 are coupled to one another by the bottom boards 130 at two points at the opposite end sides of the stringer boards 120. However, instead of the bottom boards 130, a board member having approximately the same size as the top board 110 and having a rectangular shape when viewed in plan view may be used.

As described above, in the pallet 100, the plural stringer boards 120 define, between the top board 110 and the bottom boards 130, spaces into which forks (prongs) of a forklift or a hand lifter, which is not illustrated, are inserted. The pallet 100 according to the first exemplary embodiment is a two-way pallet, and the three stringer boards 120 each extending long in the depth direction (Y-axis direction) are arranged in the transverse direction (X-axis direction). The forks (prongs) are inserted into the two spaces, each of which is formed between a stringer board 122 that is one of the stringer boards 120 positioned in the middle and one of right and left stringer boards 121, from the front or rear of the spaces in the depth direction (Y-axis direction), so that the pallet 100 may be transported.

The top board 110, the stringer boards 120, and the bottom boards 130 are made of wood and are fixed to one another with nails. More specifically, the top board 110 and the bottom boards 130 are each formed of a normal plywood having a quality equivalent to Japanese Agricultural Standard (JAS) Class II, Type II, and each of the stringer boards 120 is formed of a board material obtained by processing a wood such as a conifer.

As illustrated in FIG. 2, the load 500 is placed onto the pallet 100. An example of the load 500 is an image forming apparatus provided with casters (wheels) 501. The load 500 is placed on the top board 110 of the pallet 100, and the top board 110 and the load 500 are tied together with a band B. When transporting the load 500 by using, for example, a forklift or a hand lifter, forks (not illustrated) of the forklift or the hand lifter are insertee between the top board 110 and the bottom boards 130, so that the pallet 100 is lifted up.

In the case where the pallet 100, on which the load 500 such as that mentioned above has been placed, falls, since the top board 110 is supported by the three stringer boards 120, the strength of the top board 110 is maintained. On the other hand, the top board 110 is less likely to be deflected in regions in which the top board 110 is in contact with the stringer boards 120, and an impact load due to the pallet 100 falling directly acts on the load 500. In particular, in the case where the load 500 is a product provided with the casters 501 as illustrated in FIG. 2, the load 500 and the top board 110 are in point contact with each other, which in turn generates a concentrated load, and thus, there is a possibility of breakage occurring in the casters 501 and portions of the load 500 to which the casters 501 are attached.

(2) Configuration of Stringer Board

Figure 3:
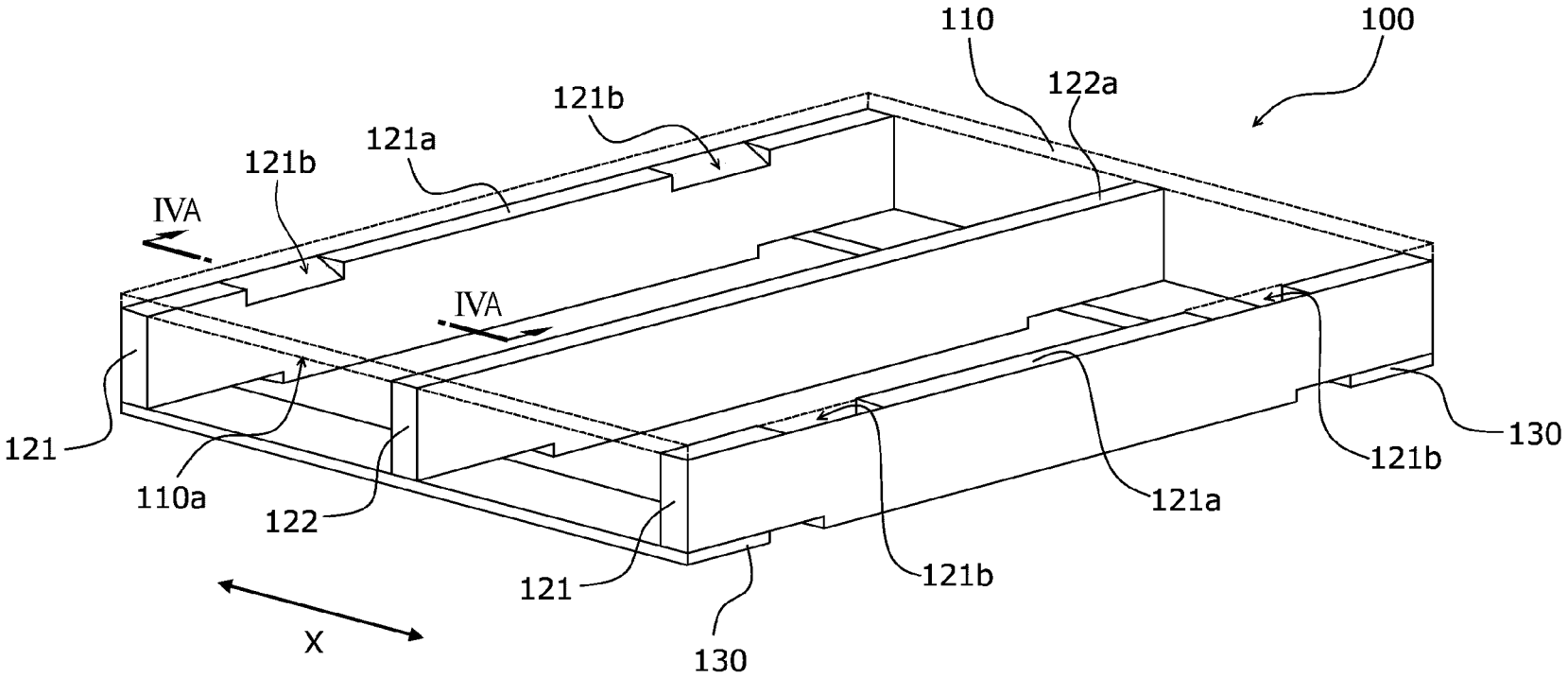
FIG. 3 is a perspective view illustrating a configuration of each stringer board by removing a top board.
Figure 4A:
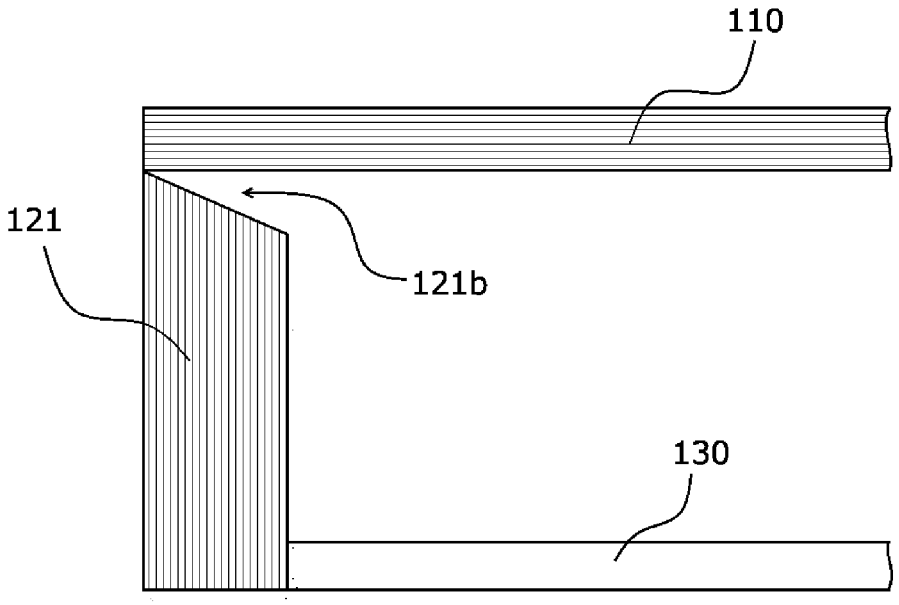
FIGS. 4A and 4B are respectively a partially enlarged view taken along line IVA-IVA of FIG. 3 and a partially enlarged schematic diagram illustrating deflection occurring in the top board when an impact load acts on the top board.
Figure 4B:
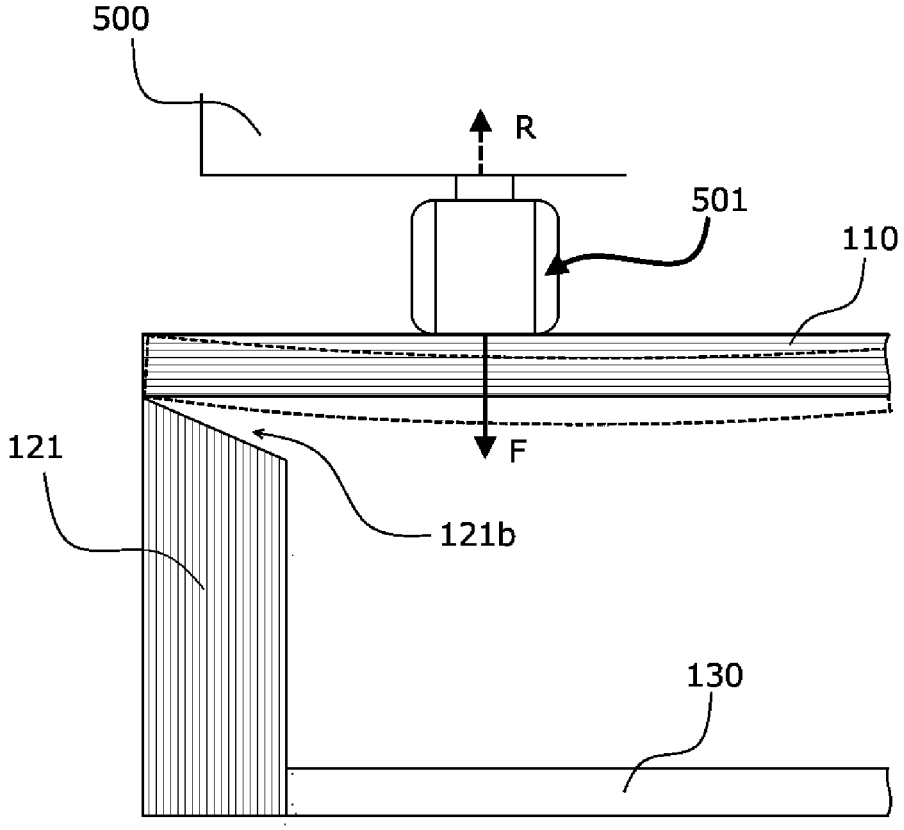
Figure 5:
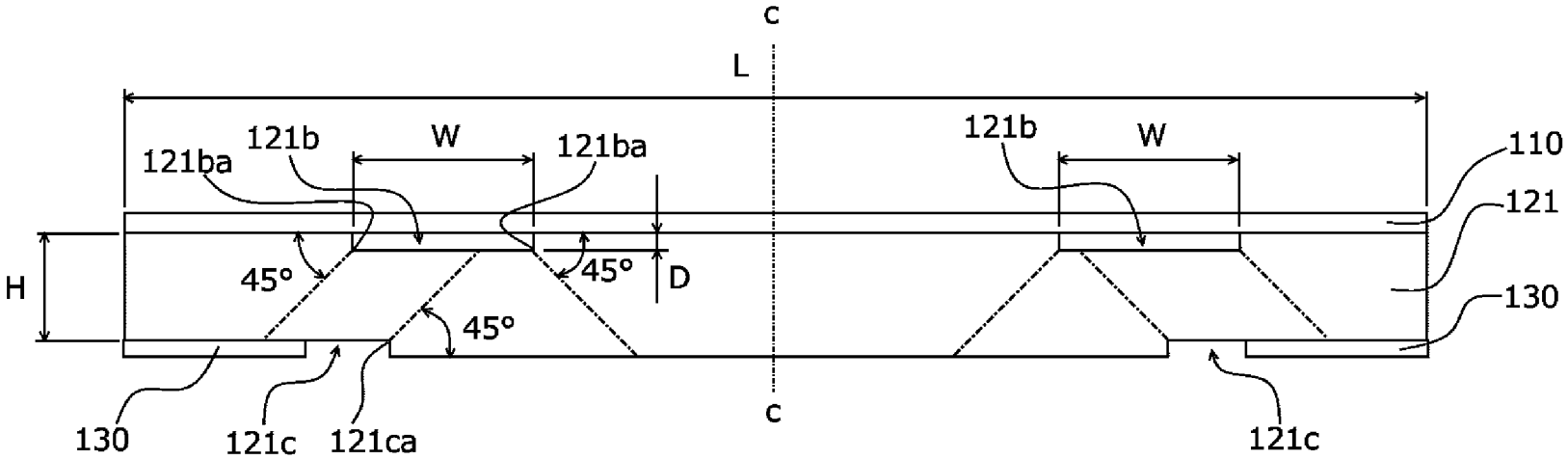
FIG. 5 is a schematic sectional view of one of the stringer boards included in the pallet in the lengthwise direction of the stringer board.

FIG. 3 is a perspective view illustrating a configuration of each of the stringer boards 120 by removing the top board 110. FIG. 4A is a partially enlarged view taken along line IVA-IVA of FIG. 3, and FIG. 4B is a partially enlarged schematic diagram illustrating deflection occurring in the top board 110 when an impact load acts on the top board 110. FIG. 5 is a schematic sectional view of one of the stringer boards 121 included in the pallet 100 in the lengthwise direction of the stringer board 121.

As illustrated in FIG. 3, the stringer boards 120 supporting the top board 110 (indicated by a dashed line in FIG. 3) include the stringer boards 121 and 121 that support the end portions of the top board 110 in the transverse direction (X-axis direction) and the stringer board 122 that supports a center portion of the top board 110.

The stringer board 122 supporting the center portion of the top board 110 supports the top board 110 from below as a result of a top surface 122*a* thereof being entirely in contact with a bottom surface 110*b* of the top board 110 in the depth direction (Y-axis direction) of the top board 110.

Each of the stringer boards 121 and 121 has a top surface 121*a* in which oblique slits 121*b* are formed in a row in the depth direction (Y-axis direction) of the top board 110 in such a manner that gaps serving as non-contact portions that are not in contact with the top board 110 are formed in regions between the top surface 121*a* and the bottom surface 110*b* of the top board 110.

Each of the oblique slits 121*b* is formed through a simple processing into a slit shape or a substantially slit shape that extends obliquely in such a manner that the gap between an inner portion of the stringer board 121 and the top board 110 is larger than the gap between an outer portion of the stringer board 121 and the top board 110.

As described above, as a result of the oblique slits 121*b* being formed in the stringer boards 121 and 121, when an impact load is applied to the top board 110, the stringer boards 121 and 121 support the entire pallet 100, and as illustrated in FIG. 4B, the top board 110 is likely to be deflected (indicated by a dashed line in FIG. 4B) in the regions in which the oblique slits 121*b*, which are the non-contact portions that are not in contact with the top board 110, are formed.

As illustrated in FIG. 5, the oblique slits 121*b*, which are formed in the stringer boards 121 and 121, each have a length W that is 10% to 15% or about 10% to about 15% of a stringer board length L, and a pair of the oblique slits 121*b* are formed at two positions in each of the stringer boards 121 and 121 with the center of the stringer board 121 (see the dotted line c-c in FIG. 5) in the lengthwise direction interposed between the two positions.

In the case where the length W is shorter than the length that is 10% or about 10% of the stringer board length L, when an impact load is applied to the top board 110, the top board 110 is less likely to be deflected in the regions in which the oblique slits 121*b*, which are the non-contact portions that are not in contact with the top board 110, are formed, and the shock-absorbing effect decreases. In the case where the length W is longer than the length that is 15% or about 15% of the stringer board length L, when an impact load is applied to the top board 110, the area in which the top board 110 is supported by the stringer boards 121 and 121 decreases, and the strength of the entire pallet 100 decreases.

As illustrated in FIG. 5, the oblique slits 121*b* are formed so as to have a non-contact-portion depth D that is 10% to 20% or about 10% to about 20% of a stringer board height H in the height direction (Z-axis direction) of the stringer boards 121 and 121. In the case where the non-contact-portion depth D is smaller than the height that is 10% or about 10% of the stringer board height H, when an impact load is applied to the top board 110, the top board 110 is less likely to be deflected in the regions in which the oblique slits 121*b*, which are the non-contact portions that are not in contact with the top board 110, are formed, and the shock-absorbing effect decreases. In the case where the non-contact-portion depth D is larger than the height that is 20% or about 20% of the stringer board height H, the amount of deflection of the top board 110 when an impact load is applied to the top board 110 is large, and the strength of the entire pallet 100 decreases.

As illustrated in FIG. 5, cutout portions 121*c* into which the bottom boards 130 are inserted are formed in each of the stringer boards 121 and 121. The cutout portions 121*c* and the oblique slits 121*b* are arranged in such a manner that the position of each of the cutout portions 121*c* and the position of a corresponding one of the oblique slits 121*b* do not coincide with each other in the vertical direction.

More specifically, the cutout portions 121*c* are formed in the end portions of the stringer boards 121 and 121 in the lengthwise direction of the stringer boards 121 and 121, and the positions of the cutout portions 121*c* are different from the positions of the corresponding oblique slits 121*b*, which are formed in the top surfaces 121*a* of the stringer boards 121 and 121, in the depth direction (Y-axis direction).

The cutout portions 121*c* and the oblique slits 121*b* are arranged in such a manner that imaginary lines (see one-dot chain lines in FIG. 5) each of which extends at 45 degrees or about 45 degrees from one of the corner portions 121*ca* of the cutout portions 121*c* and the corner portions 121*ba* of the oblique slits 121*b* do not coincide with one another.

Modification 1

Figure 6A:
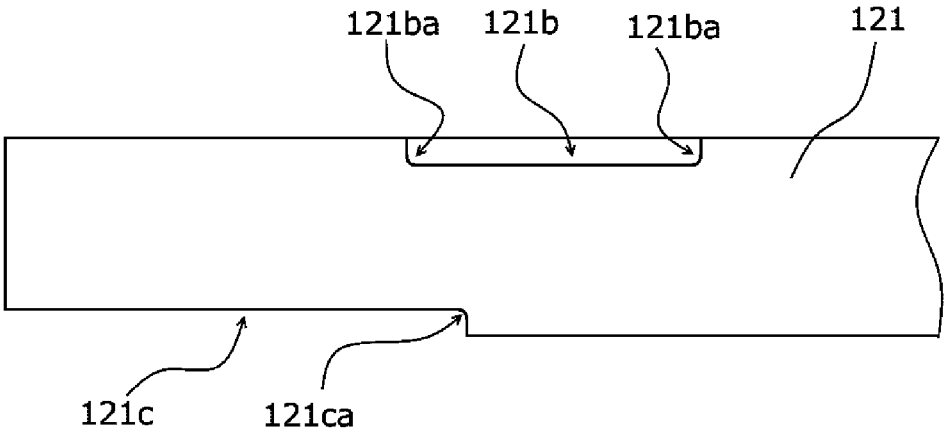
FIGS. 6A and 6B are diagrams each illustrating a cutout shape of a cutout portion and a cutout shape of an oblique slit according to Modification 1.
Figure 6B:
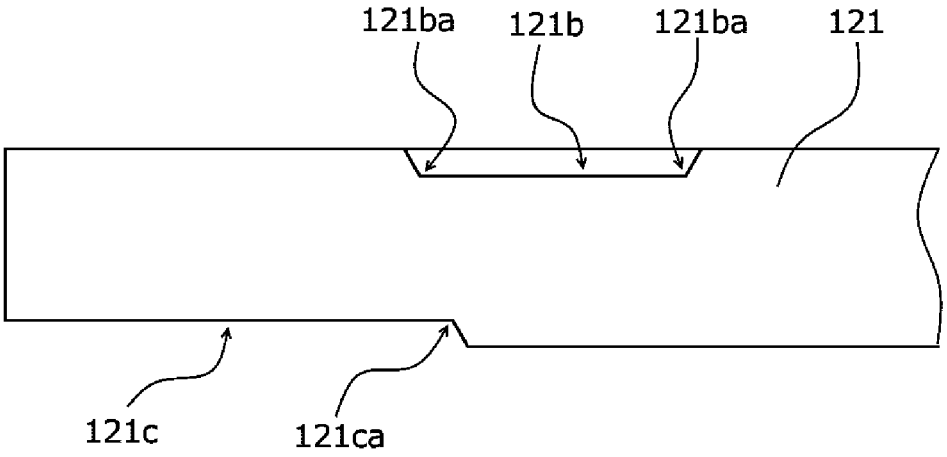

FIGS. 6A and 6B are diagrams each illustrating a cutout shape of one of the cutout portions 121*c* and a cutout shape of one of the oblique slits 121*b* according to Modification 1. As illustrated in FIG. 6A, the corner portions 121*ca* of the cutout portions 121*c* and the corner portions 121*ba* of the oblique slits 121*b* may each have a round shape or a substantially round shape. Alternatively, as illustrated in FIG. 6B, the corner portions 121*ca* of the cutout portions

121*c* and the corner portions 121*ba* of the oblique slits 121*b* may each form an obtuse angle.

Modification 2

Figure 7A:
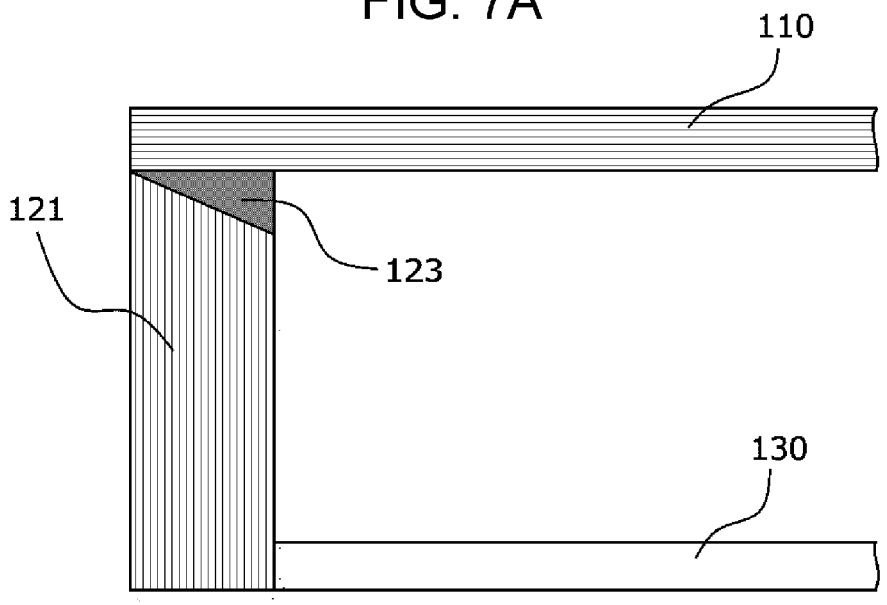
FIGS. 7A and 7B are respectively a partially enlarged view illustrating contact between an oblique slit and a top board according to Modification 2 and a partially enlarged schematic diagram illustrating deflection occurring in the top board when an impact load acts on the top board.
Figure 7B:
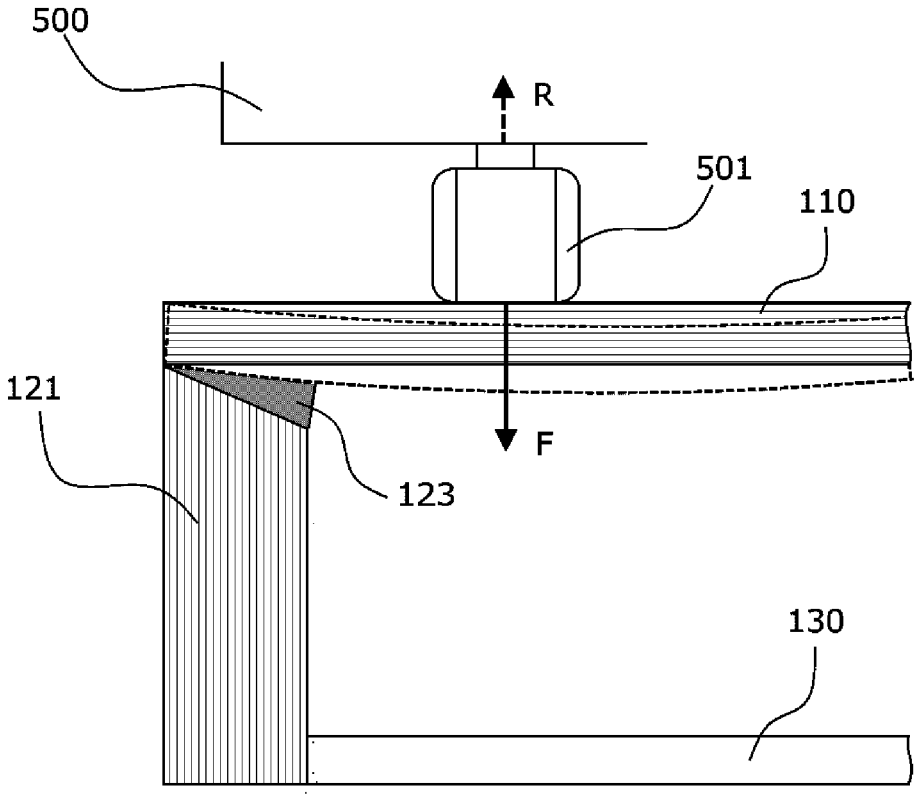

FIG. 7A is a partially enlarged view illustrating contact between one of the oblique slits 121*b* and the top board 110 according to Modification 2, and FIG. 7B is a partially enlarged schematic diagram illustrating deflection occurring in the top board 110 when an impact load acts on the top board 110.

As illustrated in FIG. 7A, buffer members 123 each of which has elasticity are disposed in the regions in which the oblique slits 121*b*, which are the non-contact portions that are not in contact with the top board 110, are formed. Examples of the buffer members 123 include members that are made of, for example, chloroprene rubber, a highly-functional urethane foam, and the like.

As a result of the buffer members 123, each of which has elasticity, being disposed in the non-contact portions, as illustrated in FIG. 7B, when the top board 110 is deflected (indicated by a dashed line in FIG. 7B) in the regions in which the oblique slits 121*b*, which are the non-contact portions that are not in contact with the top board 110, are formed, part of an impact force is absorbed by the buffer members 123.

Modification 3

Figure 8:
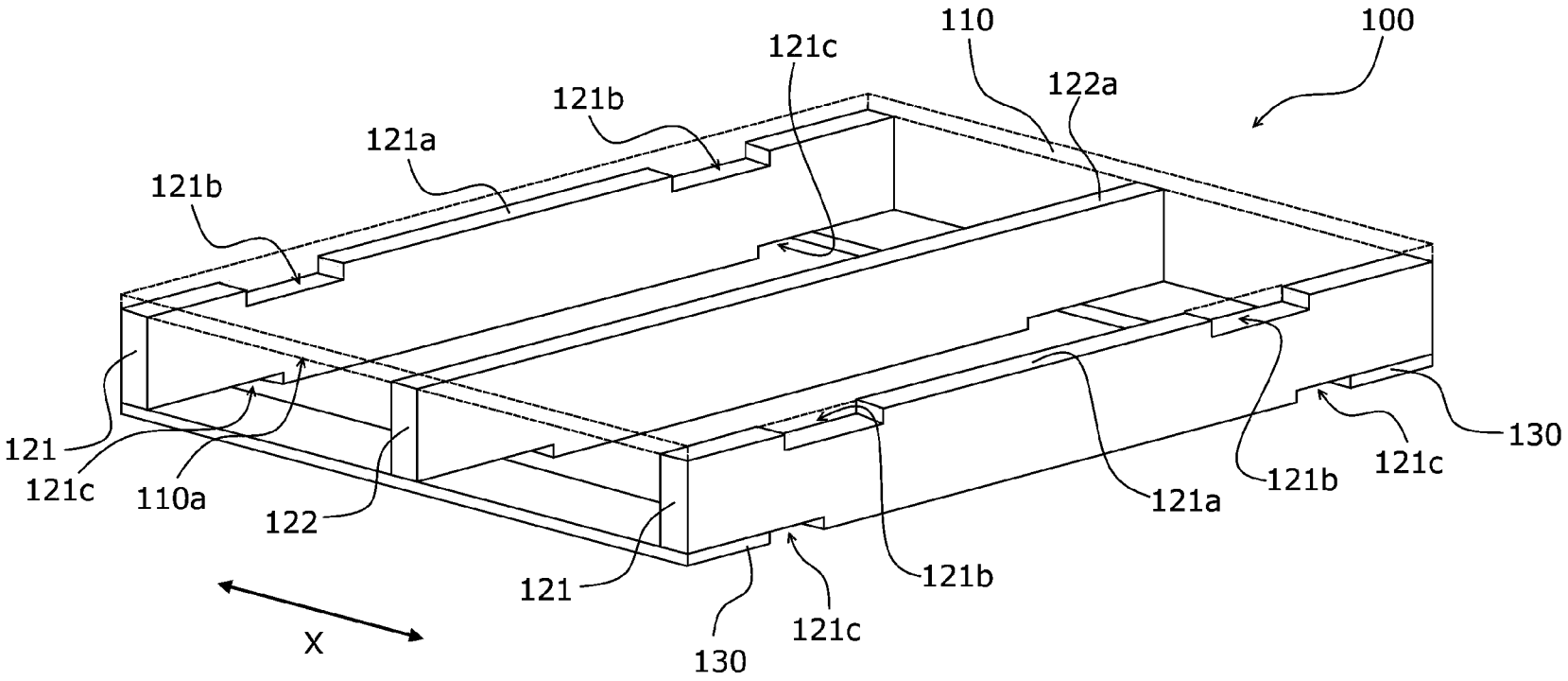
FIG. 8 is a perspective view illustrating a configuration of each stringer board according to Modification 3.

FIG. 8 is a perspective view illustrating a configuration of each of the stringer boards 120 according to Modification 3. Instead of the oblique slits 121*b*, as the non-contact portions that are formed in the top surfaces 121*a* of the stringer boards 121 and 121 and that are not in contact with the top board 110, non-contact regions may be uniformly formed such that a portion of each of the non-contact regions formed in the inner portion of the corresponding stringer board 121 and the other portion of the non-contact region formed in the outer portion of the corresponding stringer board 121 are the same as each other. In this case, the operation of processing the non-contact portions may be simpler than that in the case of forming each of the non-contact portions into an oblique slit shape. In particular, the non-contact portions and the cutout portions 121*c* may be processed in the same process by setting the stringer boards 121 and 121 in such a manner that the surfaces of the stringer boards 121 and 121 face in the vertical direction, and thus, the overall processing of the stringer boards 121 and 121 may be simpler.

(3) Configuration of Top Board

Figure 9:
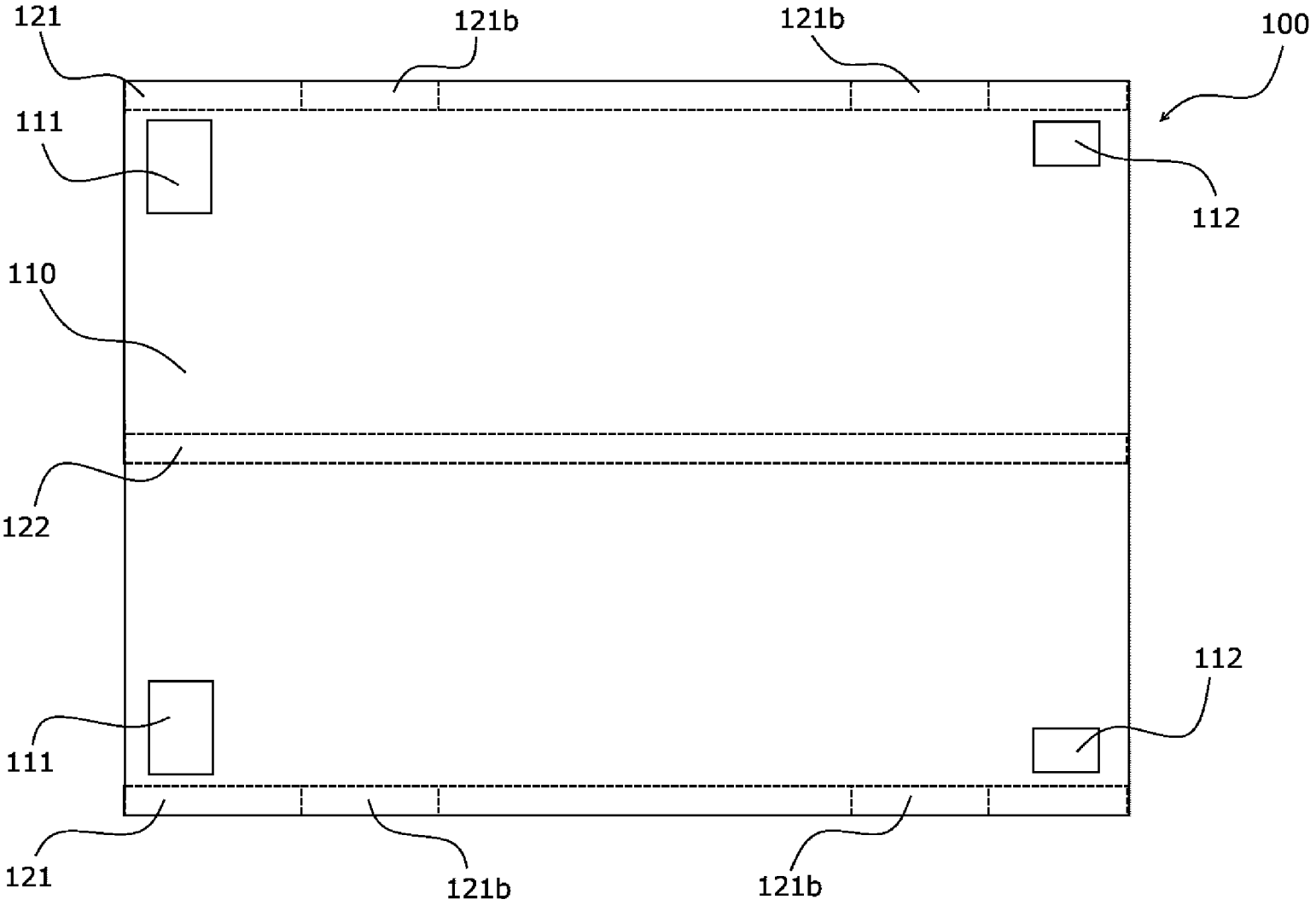
FIG. 9 is a plan view of the top board of the pallet.

FIG. 9 is a plan view of the top board 110 of the pallet 100.

As illustrated in plan view in FIG. 9, receiving plates 111 and receiving plates 112 that receive the casters 501 of the load 500 are disposed on the top surface 110*a* of the top board 110. Each of the receiving plates 111 and 112 is disposed in the vicinity of a corresponding one of the oblique slits 121*b* on the side on which the top board 110 and a corresponding one of the stringer boards 121 and 121 (see dashed lines in FIG. 9) are in contact with each other.

Modification 1

Figure 10A:
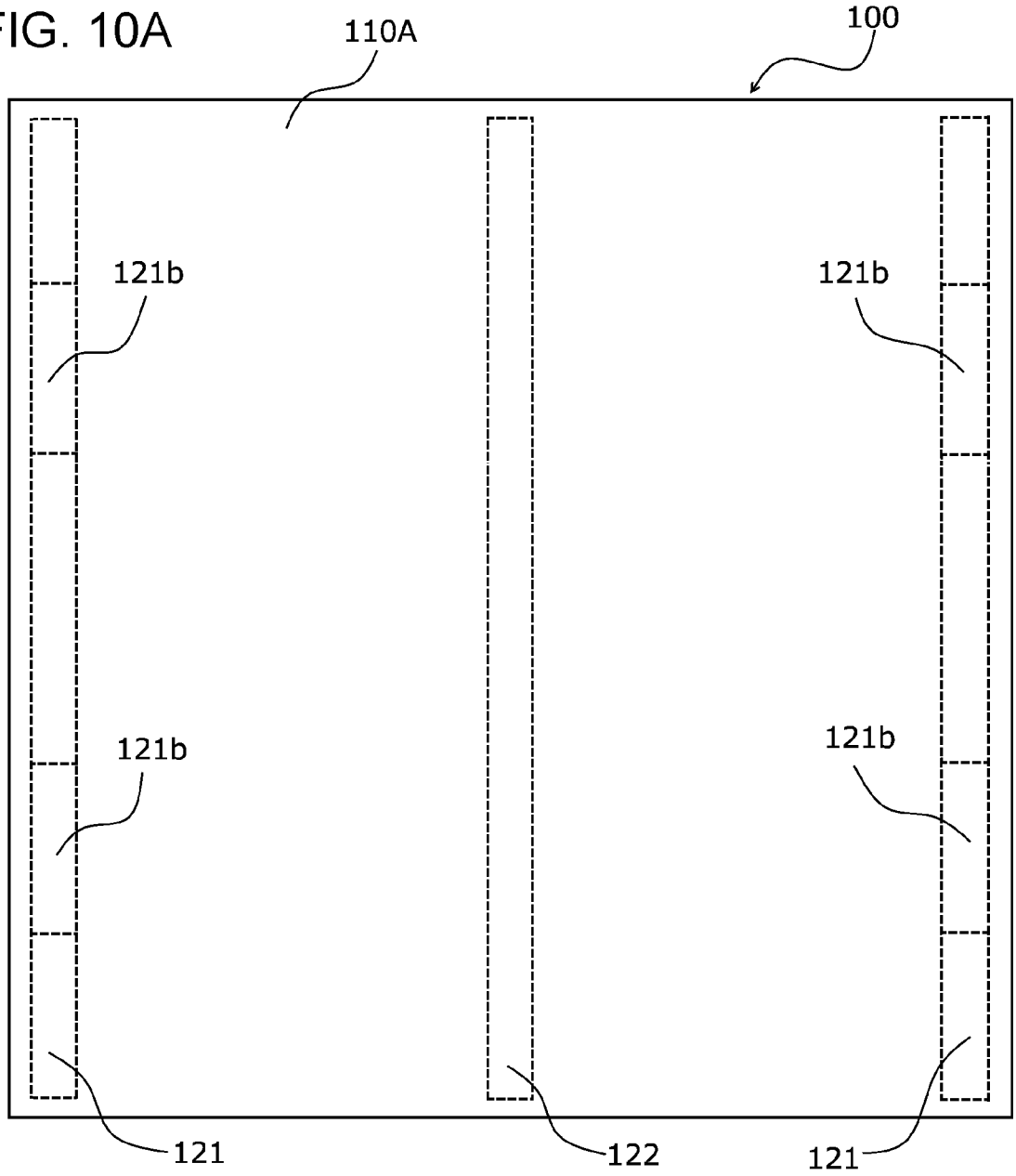
FIGS. 10A and 10B are a plan view and a front view of the pallet that includes a top board according to Modification 1.
Figure 10B:
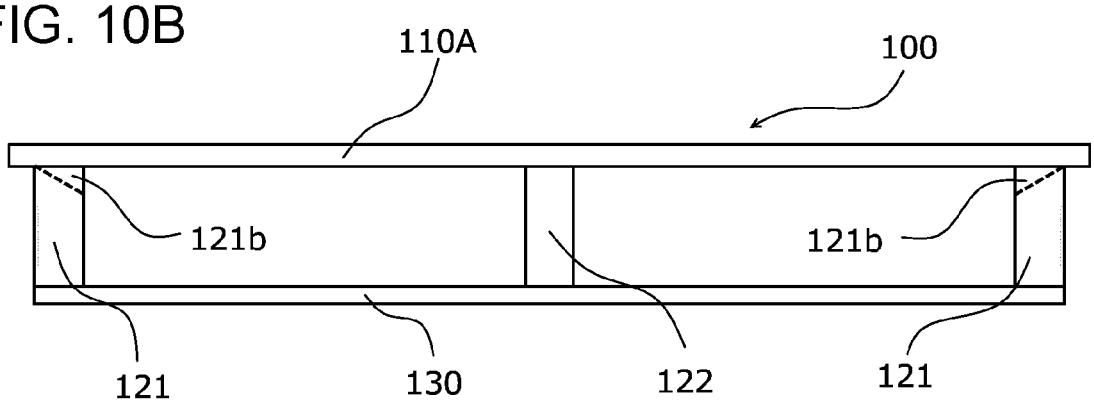

FIGS. 10A and 10B are a plan view and a front view of the pallet 100 that includes a top board 110A according to Modification 1. As illustrated in FIGS. 10A and 10B, the top board 110A extends in such a manner that portions thereof are located outside the stringer boards 121 and 121. As a result of the top board 110A extending in such a manner that the portions thereof are located outside the stringer boards 121 and 121, when an impact load is applied to the top board 110A, even if the top board 110A is deflected in the regions in which the oblique slits 121*b*, which are non-contact portions that are not in contact with the top board 110A, are formed, the contact between the top board 110A and the stringer boards 121 and 121 may be maintained with certainty.

Modification 2

Figure 11:
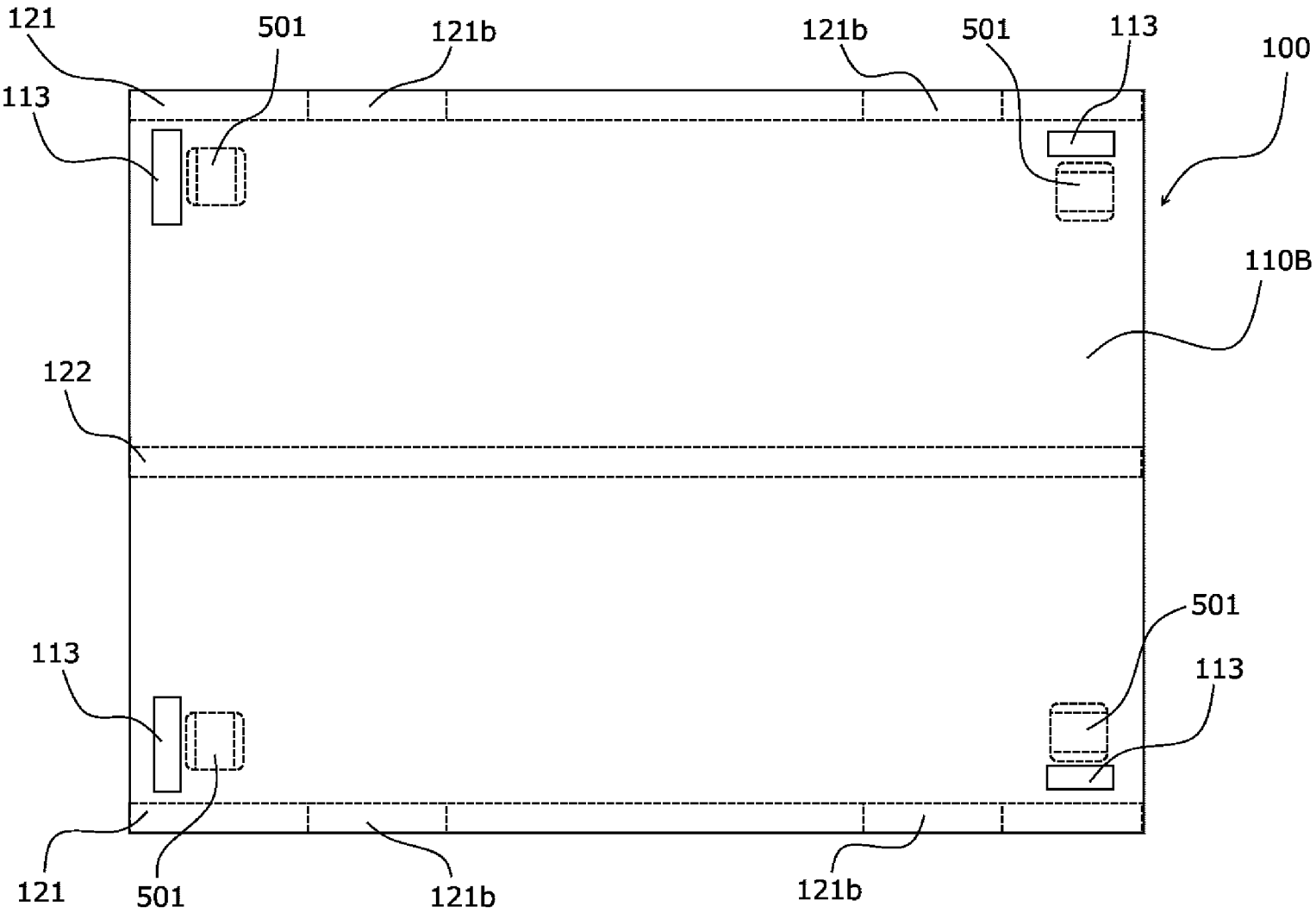
FIG. 11 is a plan view of the pallet that includes a top board according to Modification 2.

FIG. 11 is a plan view of the pallet 100 that includes a top board 110B according to Modification 2. As illustrated in FIG. 11, the top board 110B is provided with guide portions 113 that define contact positions at which the top board 110B is brought into contact with the load 500. The guide portions 113 are each formed in the vicinity of one of the regions in which the oblique slits 121*b*, which are non-contact portions that are not in contact with the top board 110B, are formed in such a manner as to have a hook-like shape and project from the top surface of the top board 110B, and the load 500 may be placed onto the pallet 100 by aligning the casters 501 of the load 500 with the guide portions 113.

Modification 3

Figure 12:
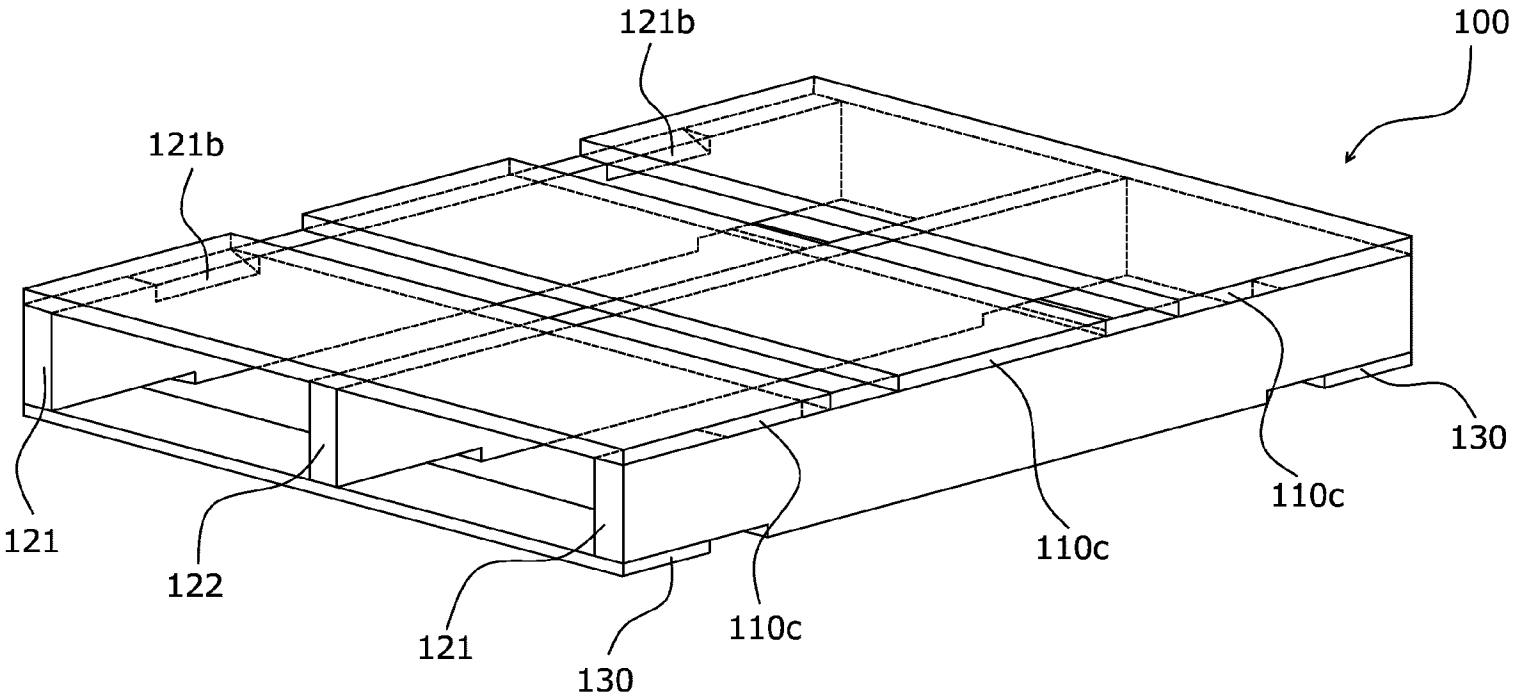
FIG. 12 is a perspective view of the pallet that includes top boards according to Modification 3.

FIG. 12 is a perspective view of the pallet 100 that includes plural top boards 110C according to Modification 3. As illustrated in FIG. 12, the plural (three in Modification 3) top boards 110C are arranged in a direction crossing the longitudinal direction of the stringer boards 121 and 121, and the oblique slits 121*b* serving as non-contact portions are formed between the top boards 110C that are positioned at either end in the longitudinal direction of the stringer boards 121 and 121 and the stringer boards 121 and 121. As a result, each of the top boards 110C may be formed of a board member having a small width.

Although the exemplary embodiments of the present invention have been described above using specific examples, the technical scope of the present invention is not limited to the above-described exemplary embodiments, and various changes may be made within the scope of the present invention.

For example, in the above-described exemplary embodiments, although a configuration has been described in which non-contact portions are formed at two positions in a stringer board, the non-contact portions are not limited to be formed at two positions as long as each of the non-contact portions is formed in such a manner as to have a width that is 10% to 15% or about 10% to about 15% of the length of the stringer board.

In addition, in the above-described exemplary embodiments, although a configuration has been described in which stringer boards are coupled to one another by a bottom board, the pallet does not necessarily include the bottom board.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A pallet comprising:

at least one top board on which a load is placed; and at least one substantially plate-shaped stringer board that is provided independently of the top board and that has at least one non-contact portion, which is not in contact with the top board in a region between the stringer board and the top board in a vertical direction, the stringer board being in contact with the top board in the vertical direction, and wherein the load contacts the top board on at least two different positions along a length direction of the stringer board, and each portion where the load and the top board are brought into contact with each aligns with a different non-contact portion in a direction perpendicular to the length direction of the stringer board, wherein a plurality of the non-contact portions are formed with a center portion of the stringer board in a longitudinal direction of the stringer board interposed between the non-contact portions.

2. The pallet according to claim 1, wherein the non-contact portion is formed in such a manner that an inner portion of the stringer board has a first region in which the stringer board and the top board are not in contact with each other and that an outer portion of the stringer board has a second region in which the stringer board and the top board are not in contact with each other, the first region being larger than the second region.

3. The pallet according to claim 2, wherein the non-contact portion is formed in a substantially slit shape that extends obliquely in such a manner that a gap between the inner portion of the stringer board and the top board is larger than a gap between the outer portion of the stringer board and the top board.

4. The pallet according to claim 2, wherein the non-contact portion is formed in such a manner that the outer portion of the stringer board is in contact with the top board.

5. The pallet according to claim 1, wherein the non-contact portion is formed in such a manner that a region in which the stringer board is not in contact with the top board is uniformly formed such that a first half of the region formed in an inner portion of the stringer board and a second half of the region formed in an outer portion of the stringer board are identical to each other.

6. The pallet according to claim 5, further comprising:

a bottom board disposed on a surface of the stringer board that is opposite to a surface of the stringer board that is in contact with the top board, wherein the stringer board has a first cutout portion into which the bottom board is inserted and a second cutout portion that forms the non-contact portion, and the first cutout portion and the second cutout portion each have a shape that enables the first cutout portion and the second cutout portion to be formed in the stringer board in an identical direction.

7. The pallet according to claim 6, wherein the first cutout portion and the second cutout portion are located at positions that do not face each other at about 45 degrees.

8. The pallet according to claim 6, wherein the first cutout portion and the second cutout portion each have a substantially rectangular shape, and a corner portion of the first cutout portion and a corner portion of the second cutout portion are each formed in a substantially round shape.

9. The pallet according to claim 1, further comprising:

a bottom board disposed on a surface of the stringer board that is opposite to a surface of the stringer board that is in contact with the top board, wherein the stringer board has a first cutout portion into which the bottom board is inserted and a second cutout portion that forms the non-contact portion, and the first cutout portion and the second cutout portion are located at positions that do not coincide with each other in the vertical direction.

10. The pallet according to claim 1, further comprising:

a bottom board disposed on a surface of the stringer board that is opposite to a surface of the stringer board that is in contact with the top board, wherein the stringer board has a first cutout portion into which the bottom board is inserted and a second cutout portion that forms the non-contact portion, and the first cutout portion and the second cutout portion are located at positions at which stress is not concentrated when deflection occurs in the stringer board.

11. The pallet according to claim 1, wherein the at least one non-contact portion includes two or more non-contact portions formed in the stringer board.

12. The pallet according to claim 1, wherein the top board extends in such a manner that a portion of the top board is located outside the stringer board.

13. The pallet according to claim 1, wherein a plurality of the top boards are arranged in a direction crossing a longitudinal direction of the stringer board, and a plurality of the non-contact portions are each formed between one of the top boards that are positioned at either end in the longitudinal direction of the stringer board and the stringer board.

14. The pallet according to claim 1, wherein the top board is made of wood.

15. The pallet according to claim 1, wherein the top board is provided with a guide portion that defines a contact position at which the load is brought into contact with the top board.

16. The pallet according to claim 15, wherein the load is positioned adjacent the guide.

17. The pallet according to claim 1, wherein the load are disposed in the vicinity of a corresponding one of the non-contact portion than a center portion of the top board.

18. A pallet comprising:

at least one top board on which a load is to be placed; and at least one substantially plate-shaped stringer board that is provided independently of the top board and that has at least one non-contact portion, which is not in contact with the top board in a region between the stringer board and the top board, the stringer board being in contact with the top board in a vertical direction;

wherein a plurality of the stringer boards are arranged in such a manner that, when viewed in plan view, one of the stringer boards is disposed on a center portion of the top board and that the other stringer boards are disposed on the opposite end portions of the top board, and only each of the stringer boards disposed on the opposite end portions of the top board has the non-contact portion and the stringer boards disposed on the center does not have the non-contact portion.

* * * * *